US008069698B2

(12) United States Patent
Murata

(10) Patent No.: US 8,069,698 B2
(45) Date of Patent: Dec. 6, 2011

(54) TRIM AND PIERCE PRESS ASSEMBLY AND METHOD OF USE

(75) Inventor: Shinichi Murata, Bennettsville, SC (US)

(73) Assignee: Musashi Seimitsu Kogyo Kabushiki Kaisha, Toyohashi-shi (JP)

( * ) Notice: Subject to any disclaimer, the term of this patent is extended or adjusted under 35 U.S.C. 154(b) by 908 days.

(21) Appl. No.: 12/101,565

(22) Filed: Apr. 11, 2008

(65) Prior Publication Data

US 2009/0255316 A1 Oct. 15, 2009

(51) Int. Cl.
*B21D 45/00* (2006.01)
*B21D 22/00* (2006.01)

(52) U.S. Cl. ..... 72/345; 72/356; 72/427

(58) Field of Classification Search ..... 72/325, 72/328, 332, 333, 340, 344, 345, 352, 353.2, 72/354.2–360, 426, 427
See application file for complete search history.

(56) References Cited

U.S. PATENT DOCUMENTS 3,675,459 A 7/1972 Dohmann
3,887,978 A 6/1975 Dohmann
4,299,112 A 11/1981 Kondo et al.
4,433,568 A * 2/1984 Kondo ..... 72/356
4,761,867 A 8/1988 Vollmer et al.
4,798,077 A 1/1989 Douglas
4,856,167 A 8/1989 Sabroff et al.
5,516,376 A 5/1996 Tsukamoto et al.
5,722,164 A 3/1998 Bernet
6,370,931 B2 4/2002 Bennett
6,711,817 B2 3/2004 Kotani
7,000,444 B2 2/2006 Roeske et al.
7,188,420 B2 3/2007 Fisher et al.

* cited by examiner

*Primary Examiner* — Teresa Ekiert
(74) *Attorney, Agent, or Firm* — Oliff & Berridge, PLC

(57) ABSTRACT

A press assembly including a die assembly having a trim die defining an annular cavity wherein the trim die is fixed to the press assembly, a punch assembly including a trim punch having an annular boss that is correspondingly shaped to the annular cavity, wherein the trim punch is movable relative to the die assembly, and an ejector assembly including an ejector arm, wherein the ejector arm is mounted to the punch assembly. The object is pressed into the annular cavity of the trim die by the annular boss of the trim punch when the annular boss is slidably received in the annular cavity, and the ejector arm pushes the object upwardly within the annular cavity of the trim die when the annular boss of the trim punch is removed from the annular cavity.

20 Claims, 8 Drawing Sheets

TRIM AND PIERCE PRESS ASSEMBLY AND METHOD OF USE

FIELD OF THE INVENTION

The present invention generally relates to press assemblies. More specifically, the present invention relates to a press assembly including a punch and die assembly for performing trimming and piercing operations on an object, and an ejector assembly to assist in removing the object from the press assembly.

BACKGROUND OF THE INVENTION

Often, when objects are formed by forging, excess material remains on the object being created that must be removed to achieve the finished product. For example, objects such as gears, sprockets, etc., that are formed by forging will often have a ring of excess material disposed around the outer periphery that is commonly referred to as flashing. As well, it may also be necessary to remove material from the bodies of these objects, thereby creating a bore so that they may be mounted on drive axles, spindles, etc.

Typically, the operations required to remove the flashing and form a bore in a forged object, such as a gear, are performed on two independent machines. For example, a first device, such as a hydraulic press, is used to perform a trimming function on the gear for removal of the flashing, whereas a second hydraulic press is used to perform a piercing function, thereby forming a bore in the gear. Because these functions are often performed on two independent machines, the object being worked on must be moved from the first device to the second device to perform both functions. When compared to performing both operations on the same device, such as a single hydraulic press, performing the functions on two independent devices increases the handling of the object as it must be removed from the first device and transferred to the second device, which can lead to increased potential for the object to be damaged. As well, existing press assemblies often have mechanisms for ejecting the object after the process has been completed. Ejector mechanisms can be complex devices and often eject the work piece in a manner that results in the object merely being pushed out of the press assembly and onto the floor. As would be expected, such methods of ejecting the object can lead to damage as it falls from the press assembly to the floor.

SUMMARY OF THE INVENTION

The present invention recognizes and addresses considerations of prior art constructions and methods. In one embodiment of the present invention, A first embodiment of the present invention provides a press assembly for performing trimming and piercing operations on an object. The press assembly includes a die assembly having a trim die defining an annular cavity wherein the trim die is fixed to the press assembly, a punch assembly including a trim punch having an annular boss that is correspondingly shaped to the annular cavity of the trim die such that the annular boss is slidably receivable in the annular cavity wherein the trim punch is movable relative to the die assembly, and an ejector assembly including an ejector arm, wherein the ejector arm is mounted to the punch assembly such that the ejector arm moves downwardly as the punch assembly moves downwardly and the ejector arm moves upwardly as the punch assembly moves upwardly. The object is pressed into the annular cavity of the trim die by the annular boss of the trim punch when the annular boss is slidably received in the annular cavity, and the ejector arm pushes the object upwardly within the annular cavity of the trim die when the annular boss of the trim punch is removed from the annular cavity.

Another embodiment of the present invention provides a press assembly for performing trimming and piercing operations on an object. The press assembly includes a die assembly including a trim die defining an annular cavity and a pierce punch. The trim die is fixed to the press assembly and the pierce punch is disposed along a longitudinal axis of the annular cavity. A punch assembly includes a trim punch having an annular boss that is correspondingly shaped to the annular cavity of the trim die such that the annular boss is slidably receivable in the annular cavity, and the trim punch is movable relative to the die assembly. An ejector assembly includes an ejector arm that is mounted to the punch assembly. The object is pressed into the annular cavity of the trim die by the annular boss of the trim punch during a downward stroke of the punch assembly, and the ejector arm pushes the object upwardly within the annular cavity of the trim die during an upward stroke of the press assembly.

Yet another embodiment of the present invention provides a method of removing excess material from an object using a press assembly having a die assembly and a cooperating punch assembly that is movable relative thereto. The method includes placing the object on the die assembly; removing the excess material from the object by moving the punch assembly downwardly relative to the die assembly such that the object is urged downwardly relative to the die assembly by the punch assembly until the excess material is removed from the object; and moving the punch assembly upwardly relative to the die assembly such that the object is moved upwardly relative to the die assembly by a portion of the punch assembly.

Other objects, features and aspects for the present invention are discussed in greater detail below. The accompanying drawings are incorporated in and constitute a part of this specification, and illustrate one or more embodiments of the invention. These drawings, together with the description, serve to explain the principals of the invention.

BRIEF DESCRIPTION OF THE DRAWINGS

A full and enabling disclosure of the present invention, including the best mode thereof, to one of ordinary skill in the art, is set forth more particularly in the remainder of this specification, including reference to the accompanying drawings, in which.

Figure 1:
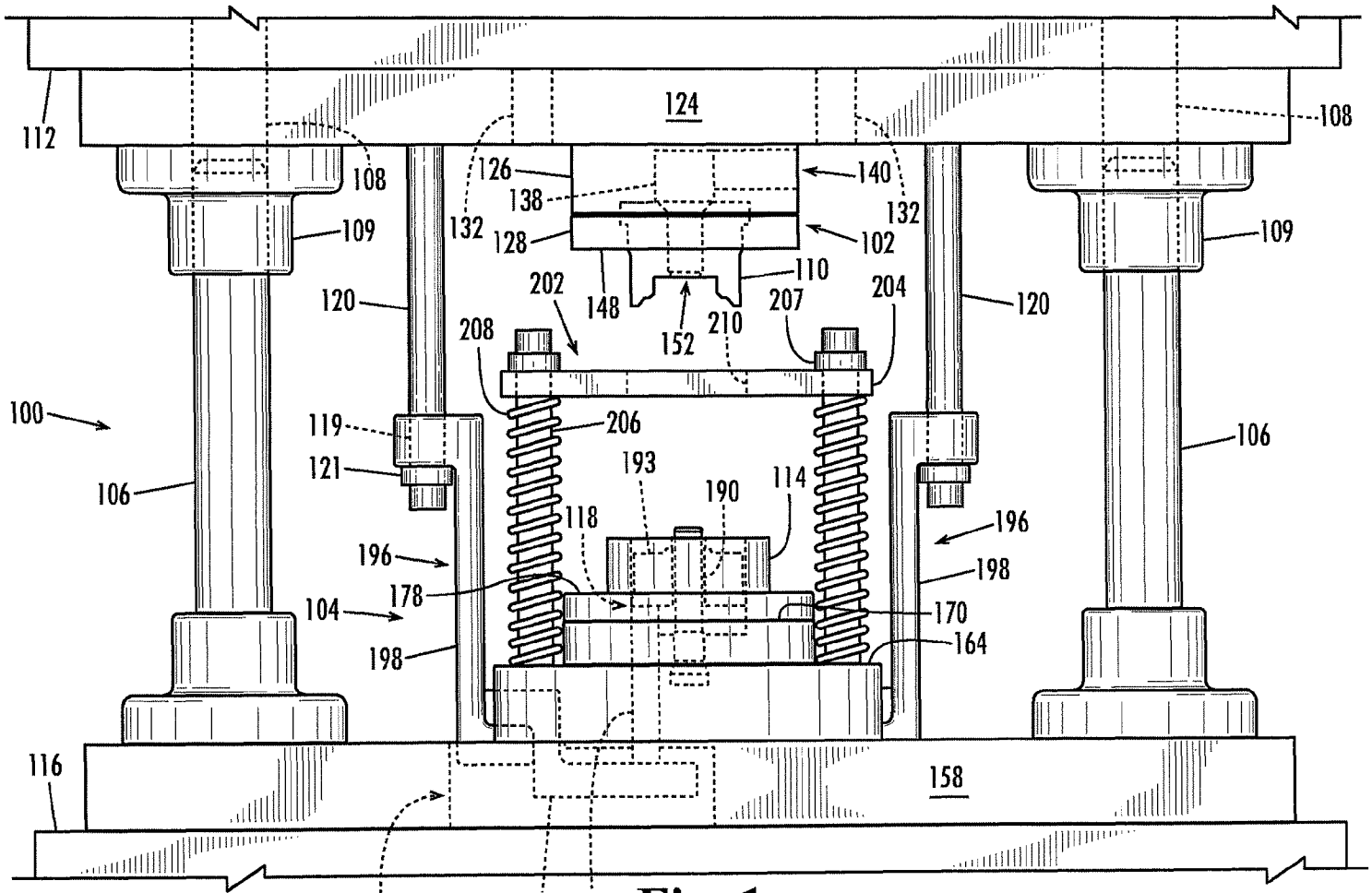
FIG. 1 is a front plan view of a trim and pierce press assembly in accordance with an embodiment of the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2A:
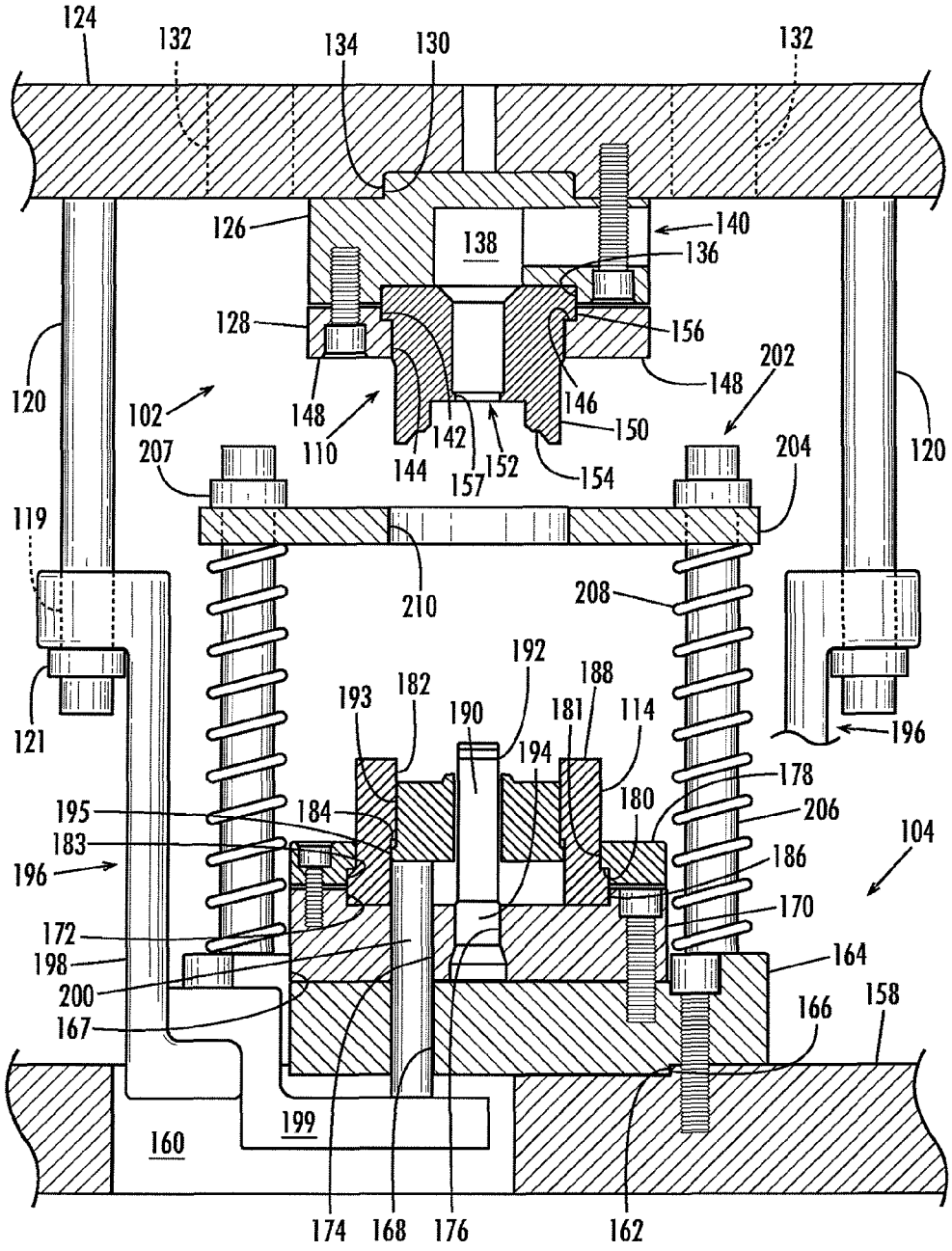
FIGS. 2A through 2F are partial cross-sectional, front plan views of the trim and pierce press assembly, as shown in FIG. 1, showing various steps in the process of conducting trimming and piercing operations on an object, in the instant case, a forged gear.

Referring now to FIGS. 1 and 2A, a preferred embodiment of a trim and pierce press assembly 100 in accordance with the present invention is shown. Press assembly 100 includes a punch assembly 102 that is movable relative to a die assembly 104 to effect both a trimming operation and a piercing operation on an object, for example, a gear, during a downward stroke of punch assembly 102, as discussed in greater detail below. Additionally, press assembly 100 includes the functionality of automatically stripping the gear from die assembly 104 during the upward return stroke of punch assembly 102, also discussed in greater detail below.

As shown, punch assembly 102 is secured to a ram 112 of press assembly 100 while die assembly 104 is secured to a bed 116 of press assembly 100. Proper alignment of punch assembly 102 with die assembly 104 is maintained during the downward and upward strokes of punch assembly 102 relative to die assembly 104 by a pair of guideposts 106 that are fixed to die assembly 104 and pass through corresponding bores 108 formed in punch assembly 102 and ram 112. As shown, the upper ends of each guidepost 106 are received in brackets 109 when punch assembly 102 is in its uppermost position, rather than extending into bores 108. As such, the extent to which guideposts 106 extend into punch assembly 102 and ram 112 during the full downward stroke is limited. An ejector assembly 118 includes a pair of ejector arms 196 that are slidably mounted to a pair of posts 120 extending downwardly from punch assembly 102, as discussed in greater detail below. Ejector arms 196 extend downwardly on opposing sides of die assembly 104. A spring plate assembly 202 is mounted to die assembly 104 such that it is disposed between punch assembly 102 and die assembly 104. Preferably, press assembly 100 is hydraulically operated.

Punch assembly 102 includes a trim punch 110 that is secured to ram 112 by a punch base plate 124, a first punch mounting plate 126 and a second punch mounting plate 128. Punch base plate 124 is secured to ram 112 and includes a recess 130 that is correspondingly shaped to a boss 134 of first punch mounting plate 126. Positioning boss 134 in recess 130 ensures that first punch mounting plate 126 is properly aligned with punch base plate 124 prior to securing first punch mounting plate 126 to punch base plate 124 with threaded fasteners, as shown. As shown, first punch mounting plate 126 includes a recess 136, a cavity 138 and an access aperture 140. As discussed in greater detail below, cavity 138 and access aperture 140 permit scrap materials from piercing operations to be readily removed from punch assembly 102.

Second punch mounting plate 128 is secured to first punch mounting plate 126 with threaded fasteners and includes a recess 142, a central aperture 144 and a shoulder 146 formed therebetween. As best seen in FIG. 2A, recess 136 of first punch mounting plate 126 and recess 142 of second punch mounting plate 128 are correspondingly shaped and configured to receive an annular lip 156 that extends outwardly from the base of trim punch 110 such that trim punch 110 is securely held between first and second punch mounting plates 126 and 128. In the preferred embodiment shown, trim punch 110 includes an annular boss 150 that extends downwardly from annular lip 156 and is received by a correspondingly-shaped aperture 144 of second punch mounting plate 128. An engaging surface 154 is disposed at the bottom of annular boss 150 and is configured to engage the desired object, such as a gear. A central bore 152 extends through annular boss 150 and is in communication with cavity 138 and access aperture 140 of first punch mounting plate 126. An annular lip 157 depends inwardly from the lowermost portion of central bore 152. Annular lip 157 functions as a pierce die for a pierce punch 190 mounted on die assembly 104. In the preferred embodiment shown, pierce punch 190 is cylindrical and correspondingly shaped to annular lip 157 so that a circular bore is created in the desired object. However, in alternate embodiments of the present invention, the cross-sectional shape of pierce punch 190 and lip 157 can be changed to create bores that are square, rectangular, oval, trapezoidal, star-shaped, etc. As well, because the preferred embodiment shown is used to perform trimming operations on a circular object, such as a gear, trim punch 110 includes an annular boss 150. Alternate embodiments of the present invention may also include bosses of varying cross-sectional shapes, such as square, rectangular, oval, trapezoidal, star-shaped, or any number of various polygonal shapes, for performing trimming operations on correspondingly shaped objects.

Die assembly 104 includes a trim die 114 that is secured to bed 116 of press assembly 100 by a die base plate 158 and three die mounting plates 164, 170 and 178. Die base plate 158 includes a cavity 160 and a recess 162 that is configured to receive a boss 166 of first die mounting plate 164. Insertion of boss 166 into recess 162 insures that first die mounting plate 164 is properly positioned prior to being secured to die base plate 158 with threaded fasteners. Cavity 160 is configured to movably receive a portion of a respective ejector arm 196, as shown. Cavity 160 allows an ejector arm 196 to extend inwardly toward a longitudinal access of trim die 114, as discussed in greater detail below. First die mounting plate 164 includes a recess 167 that is configured to receive the correspondingly-shaped bottom potion of second die mounting plate 170 and an ejector bore 168 that is configured to slidably receive an ejector piston 200 of ejector assembly 118.

Trim die 114 is secured between second and third die mounting plates 170 and 178, which are in turn secured to first die mounting plate 164. Second die mounting plate 170 includes an annular recess 172 and a bore aperture 174 that is configured to slidably receive ejector piston 200. A cavity 176 is formed in second die mounting plate 170 and is correspondingly-shaped to a base portion 194 of pierce punch 190. As such, securing second die mounting plate 170 adjacent first die mounting plate 164 secures pierce punch 190 along the longitudinal access of trim die 114. Third die mounting plate 178 includes a recess 183, an annular aperture 181 that is configured to receive trim die 114, and an annular shoulder 180 formed between recess 183 and annular aperture 181. Recess 172 of second die mounting plate 170 and recess 183 of third die mounting plate 178 are correspondingly-shaped such that annular lip 186 that extends outwardly from the base of trim die 114 is received therein and annular shoulder 180 of third die mounting plate 178 engages annular lip 186. In the preferred embodiment shown, trim die 114 includes an annular cavity 182 that is configured to slidably receive both annular bore 150 of trim punch 110 and an ejector ring 193 of ejector assembly 118. However, as previously noted, the cross-sectional shape of bore 150 can be varied in order to perform trimming operations on variously shaped objects. As such, the cross-sectional shape of cavity 182 can also be varied such that it corresponds to the cross-sectional shape of bore 150 of trim punch 110.

Ejector assembly 118 includes a pair of ejector arms 196 slidably mounted to a pair of posts 120 that extend downwardly from punch assembly 102. Each ejector arm 196 includes a vertical member 198 that is slidably mounted to a respective post 120 and a horizontal member 199 that is disposed in a respective cavity 160 of die base plate 158 and extends inwardly toward the longitudinal center axis of trim die 114. Note, for ease of description, although the preferred embodiment shown includes two ejector arms 196, only one is described herein for ease of description. Horizontal portion 199 of ejector arm 196 engages a bottom portion of ejector piston 200 which extends upwardly through ejector bores 168 and 174 of first and second die mounting plates 164 and 170, respectively. A top portion of ejector piston 200 extends into annular cavity 182 of trim die 114. The upper portion of ejector piston 200 engages the bottom surface of ejector ring 193, which is slidably received within annular cavity 182 of trim die 114. Upward motion of ejector ring 193 within an annular cavity 182 is limited by an annular shoulder 184 disposed within annular cavity 182 that engages an annular shoulder 195 on ejector ring 193. Note, because upper portion 198 of ejector arm 196 is slidably mounted to post 120, the vertical range of motion of ejector arm 196 is substantially less than the stroke range of punch assembly 102. For example, the stroke range of ejector arm 196 in the embodiment shown may be approximately 20 mm, whereas the stroke range of punch assembly 102 may be 200 mm. Also the stroke range of ejector arm 196 can be varied as desired by changing the vertical position of stop 121 on post 120. The higher stop 121 is on post 120, the larger the stroke range of ejector arm 196.

As shown, spring plate assembly 202 includes a spring plate 204 that slidably receives posts 206 through respective apertures at each corner. Posts 206 are mounted to first die mounting plate 164 and a coil spring 208 is disposed about each post 206 beneath spring plate 204. As such, the biasing force exerted by coil springs 208 forces spring plate 204 upwardly along posts 206. A plurality of stops 207, each disposed on a respective post 206, limit the upward travel of spring plate 204 along the posts. Spring plate 204 defines a central aperture 210 that is configured to slidably receive annular boss 150 of trim punch 110.

Operation

Figure 2B:
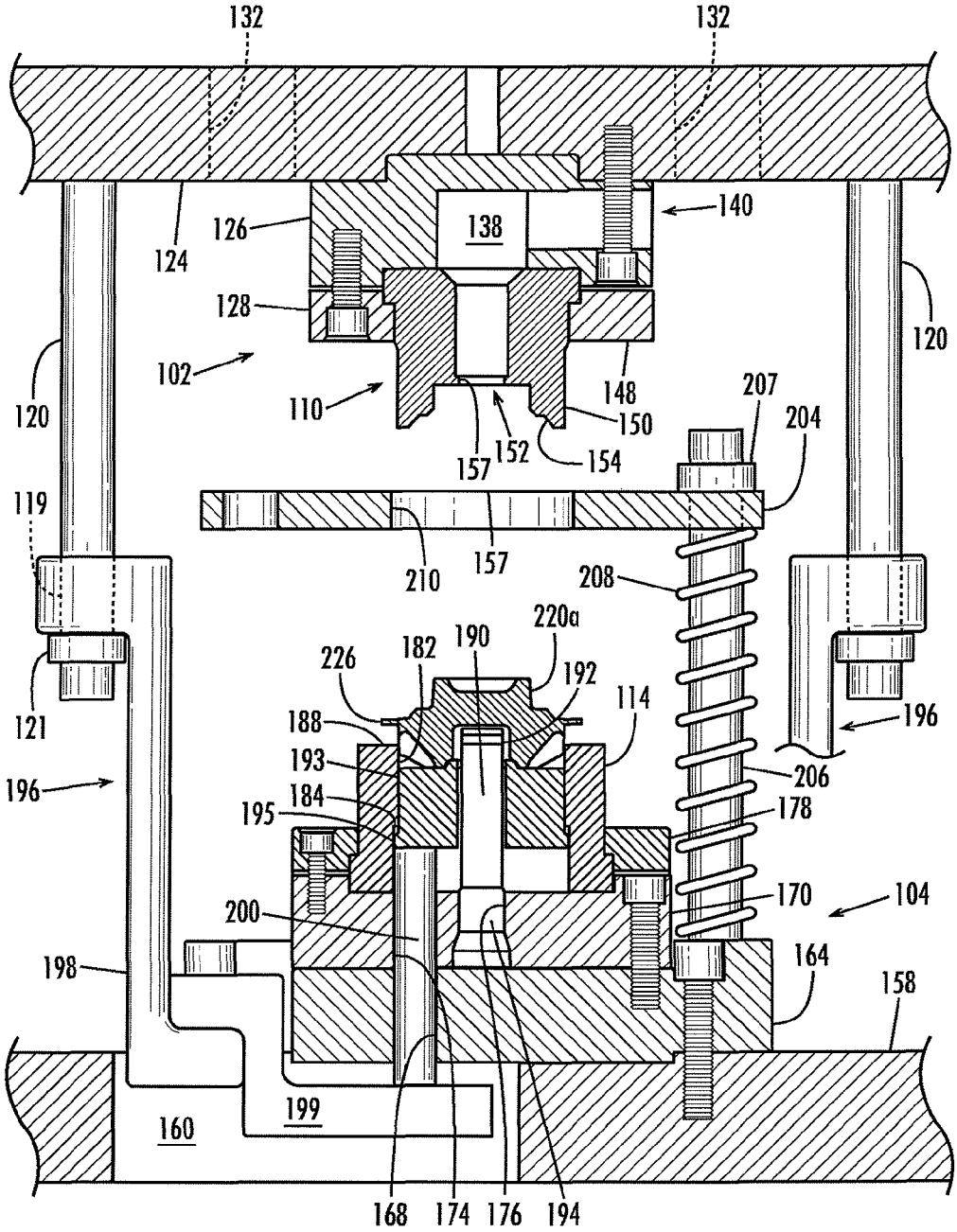

Referring now to FIGS. 2A through 2F, the operational sequence of a trimming and piercing operation with the above described press assembly 100 is discussed. The preferred embodiment of the present invention described above is configured to perform a trimming and piercing operation on a previously forged, straight-beveled gear 220*a*, as shown in FIG. 3A. As shown, gear 220*a* includes an annular array of teeth 222 disposed around the gear's body 224. A pair of recesses 227 and 229 is also formed in body 224 during the forging process. In the present case, the forging process leaves excess material 228 between recesses 227 and 229 that must be removed to form a bore 230 (FIG. 3B) for mounting the gear on a shaft, as well as excess material extending outwardly from the outer periphery of the gear's body 224, commonly referred to as flashing. The trimming and piercing operation described below results in removal of flashing 226 and formation of bore 230, and results in a gear 220*b*, as shown in FIG. 3B.

As shown in FIG. 2A, punch assembly 102 is in the starting, uppermost position relative to die assembly 104. Note, for ease of description, only one ejector arm 196 is shown in the figures and discussed. In the starting position, a stop 119 on post 120 engages vertical member 198 of ejector arm 196 so that ejector arm 196 is also in its uppermost position. As such, horizontal member 199 of ejector arm 196 maintains ejector ring 193 in its uppermost position within annular cavity 182 of trim die 114 by exerting force thereon with ejector piston 200. As shown in FIG. 2B, gear 220*a* is positioned within annular cavity 182 of trim die 114 such that flashing 226 is positioned above a top surface 188 of trim die 114 and a top portion 192 of pierce punch 190 extends upwardly into recess 227 of gear 220*a*. As shown, gear 220*a* is resting on ejector ring 193 such that a small gap exists between pierce punch 190 and gear 220*a*. Note, however, alternate embodiments can include an ejector ring 193 that is maintained in a lower position within trim die 114 such that gear 220*a* is supported on pierce punch 190. As well, as discussed above, alternate embodiments of the present invention can be used to perform trimming operations having peripheral shapes other than circular, i.e., square, oval, triangular, polygonal, etc.

Figure 2C:
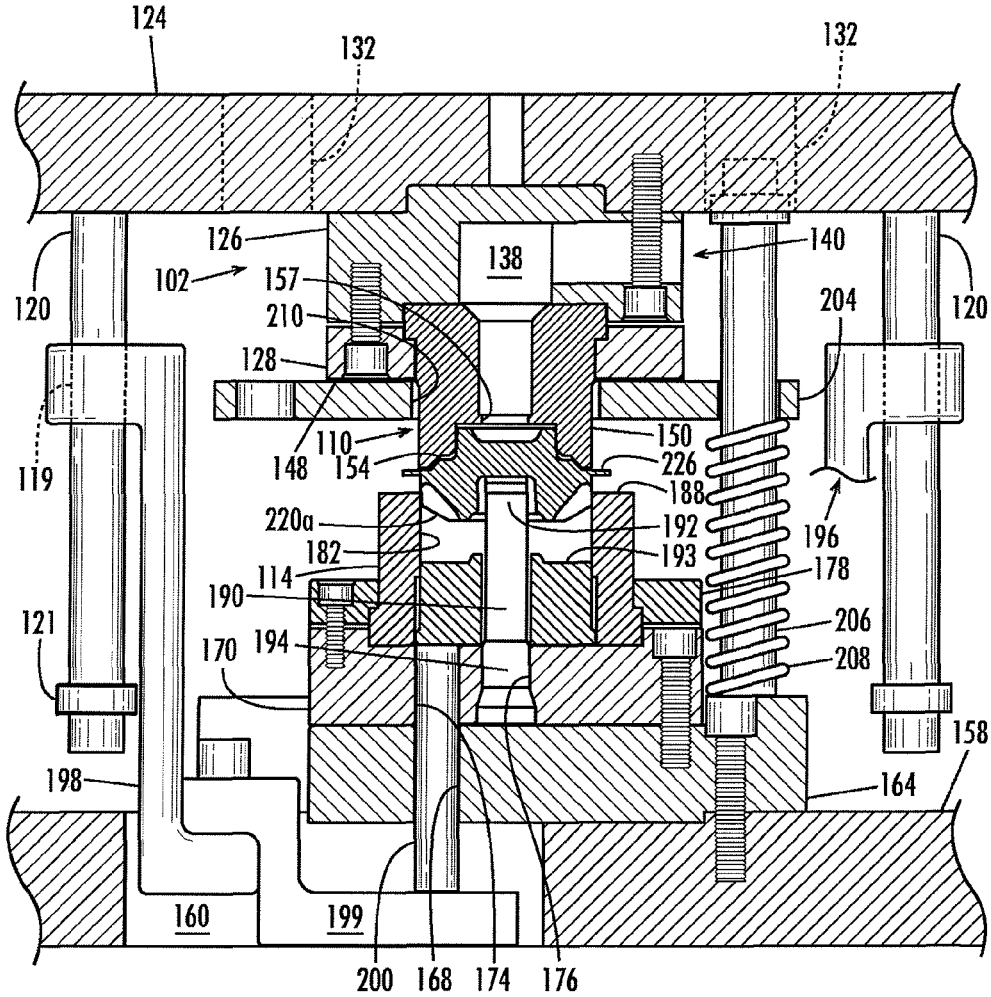
Figure 3A:
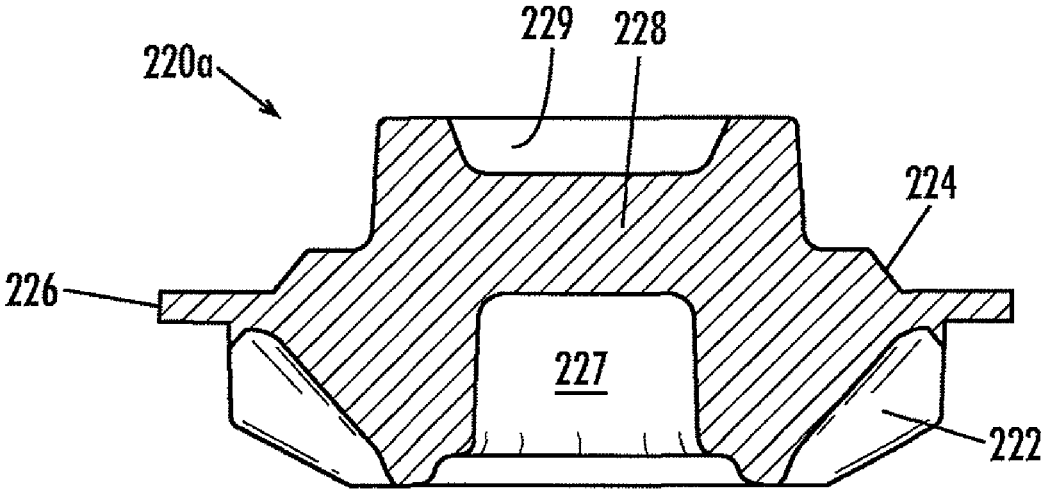
FIGS. 3A and 3B are cross-sectional views of a gear before and after, respectively, trimming and piercing operations in accordance with the present invention.
Figure 3B:
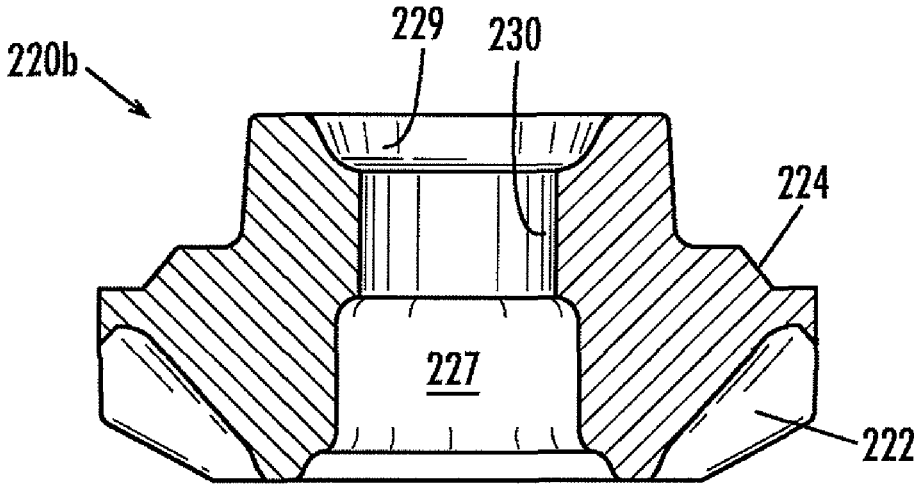

Referring now to FIG. 2C, as the downward stroke of punch assembly 102 begins, ejector arm 196 also moves downwardly since it is supported by stop 121 on post 120. Downward motion of ejector arm 196 continues until horizontal member 199 of the ejector arm reaches the bottom of the respective ejector cavity 160 formed in die base plate 158. As horizontal member 199 of ejector arm 196 moves downwardly in ejector cavity 160, ejector piston 200 also moves downwardly through ejector bore 168 of first die mounting plate 164 and ejector bore 174 of second die mounting plate 170. As such, ejector ring 193 also moves downwardly within annular cavity 182 of trim die 114. As ejector ring 193 moves downwardly, it no longer supports gear 220*a*, and gear 220*a* is eventually supported by top portion 192 of pierce punch 190. As punch assembly 102 continues to move downwardly, post 120 continues to pass through bore 119 formed in vertical member 198 of ejector arm 196.

As the downward stroke of punch assembly 102 continues, annular boss 150 of trim punch 110 passes through central aperture 210 of spring plate 204 until a bottom surface 148 of second punch mounting plate 128 abuts the top surface of spring plate 204. Continued downward motion of punch assembly 102 causes spring plate 204 to be urged downwardly against the upward biasing force of coil springs 208. As shown in FIG. 2C, engaging surface 154 of trim punch 110 eventually makes contact with gear 220*a* such that downward force is exerted on gear 220*a* by trim punch 110 and upward force is exerted on gear 220*a* by top portion 192 of pierce punch 190.

Figure 2D:
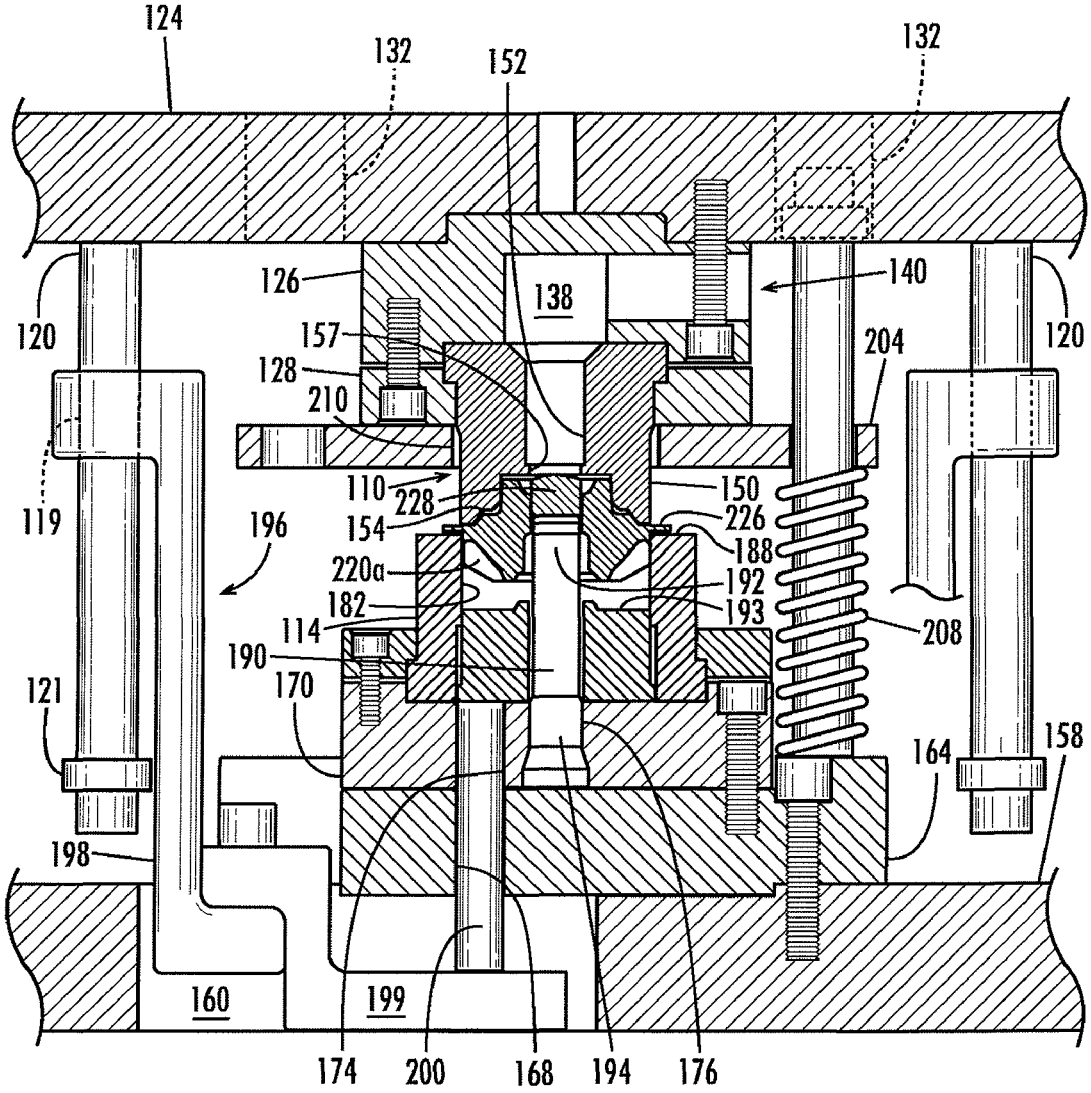

Referring now to FIG. 2D, as continued downward force is exerted on gear 220*a* by trim punch 110, gear 220*a* is moved downwardly within annular cavity 182 of trim die 114 over pierce punch 190. As gear 220*a* is urged downwardly, top portion 192 of pierce punch 190 begins to pass through gear 220*a*, thereby removing a cylindrical portion of material 228, commonly referred to as a "knock-out." Annular lip 157 that depends inwardly from central bore 152 of trim punch 110 functions as a pierce die for pierce punch 190. As discussed above, alternate embodiments of the present invention can be used to perform piercing operations on objects that result in a bore being formed that is non-circular, i.e., a bore that is square, oval, triangular, polygonal, etc. Note also, as gear

220*a* is urged downwardly with an annular cavity 182 of trim die 114, flashing 226 of gear 220*a* eventually abuts top surface 188 of trim die 114.

Figure 2E:
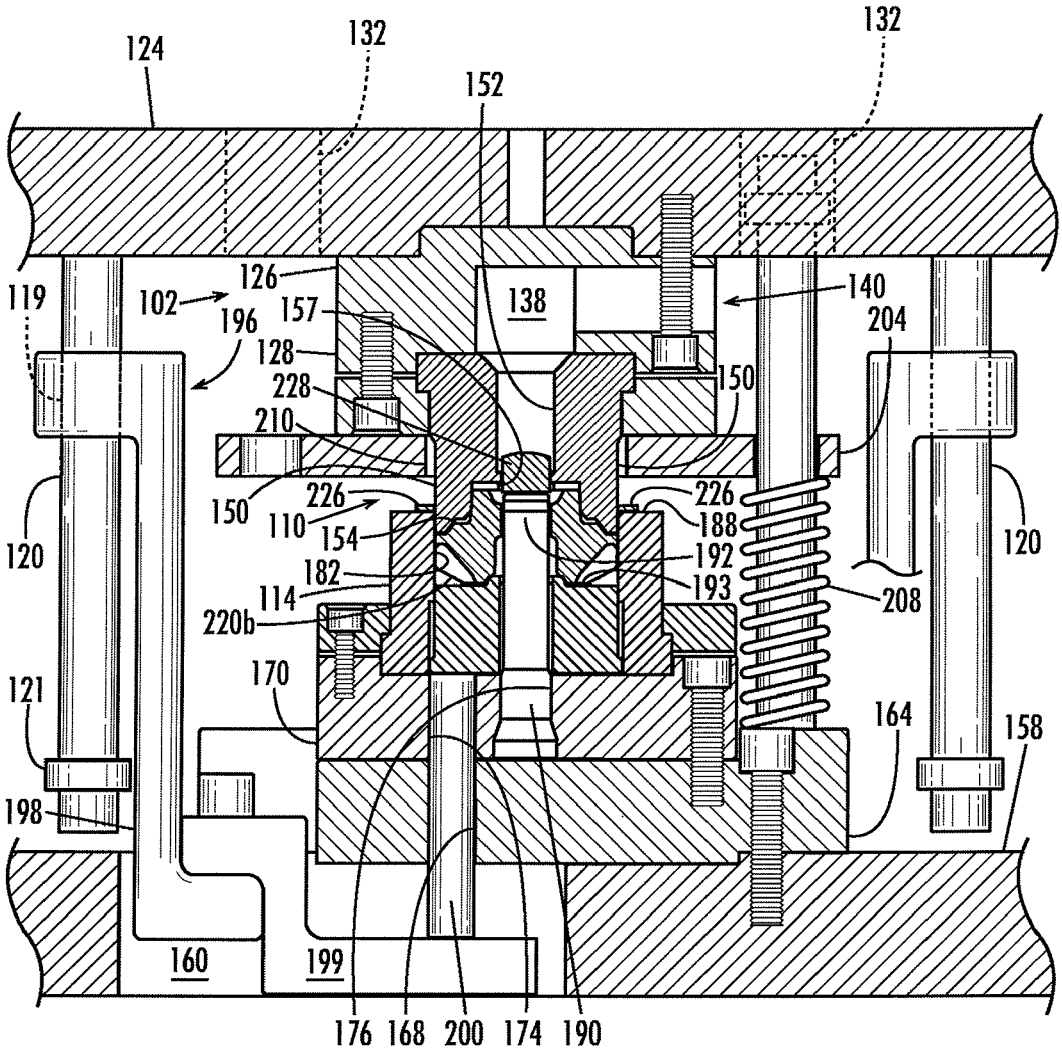

Referring now to FIG. 2E, downward motion of punch assembly 102 continues until annular boss 150 of trim punch 110 passes into annular cavity 182 of trim die 114. Annular boss 150 and annular cavity 182 are correspondingly-shaped such that as annular boss 150 enters annular cavity 182, flashing 226 is sheared from the body of gear 220*a*. As well, continued downward motion of gear 220*a* within annular cavity 182 of trim die 114 allows pierce punch 190 to fully remove knock-out 228 and urge knock-out 228 upwardly through annular lip 157 into central bore 152 of trim punch 110. As well, further downward motion of gear 220*b* within annular cavity 182 results in gear 220*b* coming to rest on ejector ring 193.

Figure 2F:
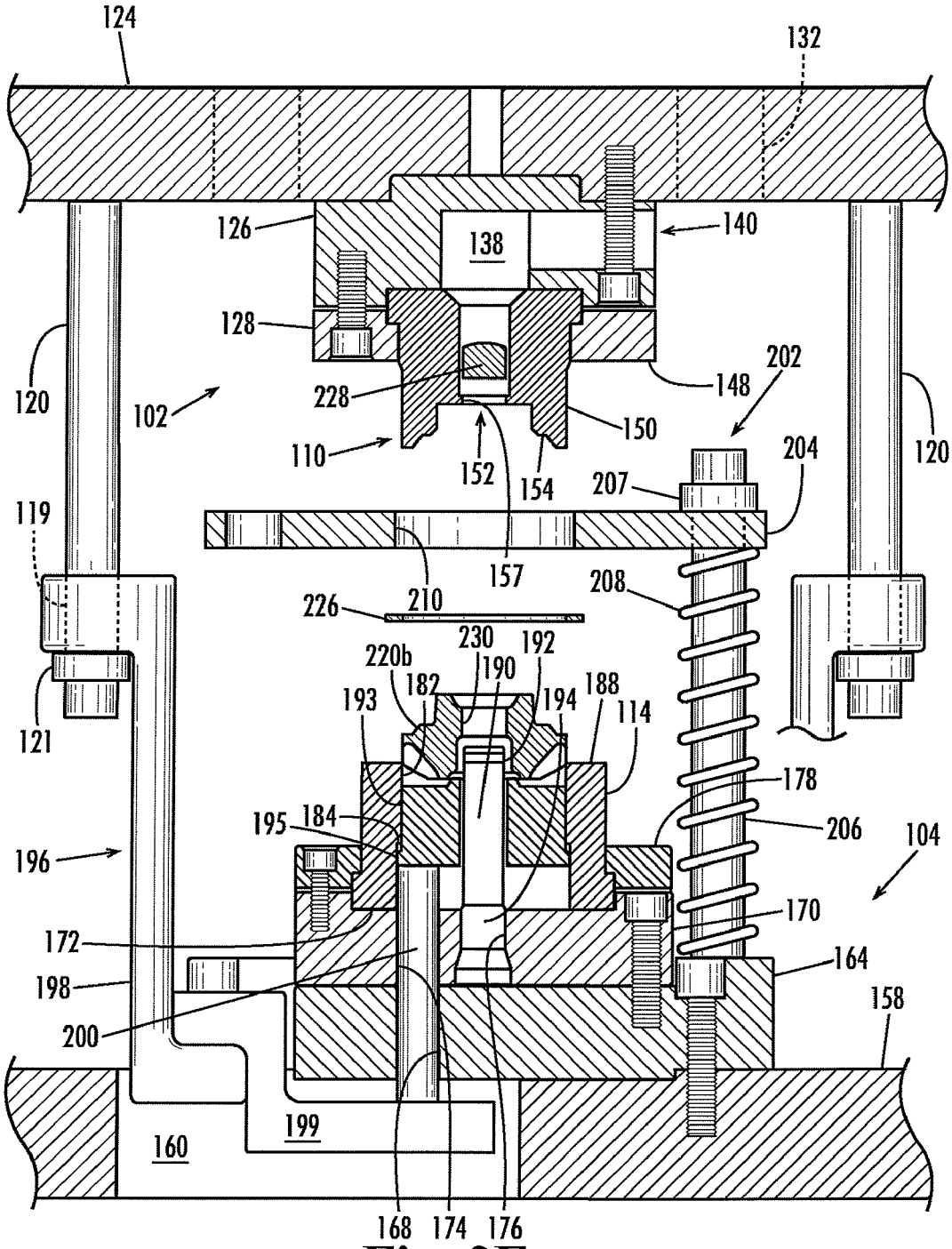

Referring now to FIG. 2F, upon completion of the downward stroke, the upward stroke of punch assembly 102 begins. Upward force is exerted on punch assembly 102 by spring plate 204 and the previously compressed coil springs 208. As punch assembly 102 moves upwardly, trim punch 110 is removed from annular cavity 182 of trim die 114 and is eventually withdrawn from central aperture 210 of spring plate 204. As well, as punch assembly 102 moves upwardly, post 120 slidably passes through bore 119 formed in vertical member 198 of ejector arm 196 until stop 121 engages the bottom surface of vertical member 198. At this time, continued upward motion of punch assembly 102 causes upward motion of ejector arm 196. Horizontal portion 199 of ejector arm 196 moves upwardly within ejector cavity 160. As such, upward force is exerted on ejector ring 193 by ejector piston 200 that is urged upwardly through ejector bores 168 and 174. As ejector ring 193 moves upwardly within annular cavity of 182 of trim die 114, gear 220*b* is also urged upwardly until clear of pierce punch 190. Note, a cylindrical center bore 230 has been formed in gear 220*b*. In the preferred embodiment shown, when punch assembly 102 is returned to its uppermost position, gear 220*b* remains seated on die assembly 104 and ready for removal, either manually or by automated means. As well, flashing 226 and knock-out 228 are removed at this time. If knock-out 228 remains in central bore 152 of trim punch 110, access aperture 140 and cavity 138 formed in first punch mounting plate 126 allow access to central bore 152 of trim punch 110 for its removal. As best seen in FIG. 3B, the above described operations result in a gear 220*b*, wherein the flashing has been removed and a cylindrical center bore 230 has been formed.

While preferred embodiments of the invention have been shown and described, modifications and variations thereto may be practiced by those of ordinary skill in the art without departing from the spirit and scope of the present invention, which is more particularly set forth in the appended claims. In addition, it should be understood the aspects of the various embodiments may be interchanged without departing from the scope of the present invention. Furthermore, those of ordinary skill in the art will appreciate that the foregoing description is by way of example only, and is not intended to limit the invention as further described in such appended claims.

What is claimed is:

1. A press assembly for performing trimming and piercing operations on an object, comprising:

a die assembly including a trim die defining an annular cavity, the trim die being fixed to the press assembly;

a punch assembly including a trim punch having an annular boss that is correspondingly shaped to the annular cavity of the trim die such that the annular boss is slidably receivable in the annular cavity, the trim punch being movable relative to the die assembly; and an ejector assembly including an ejector arm, the ejector arm being mounted to the punch assembly such that the ejector arm moves downwardly as the punch assembly moves downwardly and the ejector arm moves upwardly as the punch assembly moves upwardly, wherein the object is pressed into the annular cavity of the trim die by the annular boss of the trim punch when the annular boss is slidably received in the annular cavity, and the ejector arm pushes the object upwardly within the annular cavity of the trim die when the annular boss of the trim punch is removed from the annular cavity.

2. The press assembly of claim 1, wherein the die assembly further comprises a pierce punch disposed within the annular cavity of the trim die.

3. The press assembly of claim 2, wherein the pierce punch is disposed along a longitudinal center axis of the trim die.

4. The press assembly of claim 2, wherein the trim punch defines a central bore that is correspondingly shaped to slidably receive an end of the pierce punch.

5. The press assembly of claim 2, wherein the ejector assembly further comprises an ejector piston having a first end adjacent the ejector arm and a second end that extends into the annular cavity of the trim die.

6. The press assembly of claim 5, wherein the ejector arm further comprises a vertical component that is slidably connected to the punch assembly and a horizontal component that is disposed beneath the trim die.

7. The press assembly of claim 6, wherein the vertical component of the ejector arm is slidably connected to a post that extends downwardly from the punch assembly.

8. The press assembly of claim 6, wherein the trim die is mounted to a base plate defining a cavity and the horizontal component of the ejector arm is disposed within the cavity of the base plate.

9. The press assembly of claim 5, wherein the ejector assembly further comprises an ejector ring disposed within the annular cavity of the trim die such that the second end of the ejector piston abuts the ejector ring.

10. The press assembly of claim 6, wherein the ejector ring includes a central bore and the pierce punch extends through the central bore of the ejector ring.

11. A press assembly for performing trimming and piercing operations on an object, comprising:

a die assembly including a trim die defining an annular cavity and a pierce punch, the trim die being fixed to the press assembly and the pierce punch being disposed along a longitudinal axis of the annular cavity;

a punch assembly including a trim punch having an annular boss that is correspondingly shaped to the annular cavity of the trim die such that the annular boss is slidably receivable in the annular cavity, the trim punch being movable relative to the die assembly; and an ejector assembly including an ejector arm, the ejector arm being mounted to the punch assembly, wherein the object is pressed into the annular cavity of the trim die by the annular boss of the trim punch, during a downward stroke of the punch assembly, and the ejector arm pushes the object upwardly within the annular cavity of the trim die during an upward stroke of the punch assembly.

12. The press assembly of claim 11, wherein the trim punch defines a central bore that is correspondingly shaped to slidably receive an end of the pierce punch.

13. The press assembly of claim 11, wherein the ejector assembly further comprises an ejector piston having a first end adjacent the ejector arm and a second end that extends into the annular cavity of the trim die.

14. The press assembly of claim 13, wherein the ejector assembly further comprises an ejection ring disposed with the annular cavity of the trim die such that the second end of the ejector piston abuts the ejector ring, and the ejector ring engages the object on the upward stroke of the press assembly.

15. The press assembly of claim 11, wherein the ejector arm further comprises a vertical component that is slidably connected to the punch assembly and a horizontal component that is disposed beneath the trim die.

16. The press assembly of claim 15, wherein the vertical component of the ejector arm is slidably connected to a post that extends downwardly from the punch assembly.

17. The press assembly of claim 15, wherein the trim die is mounted to a base plate defining a cavity and the horizontal component of the ejector arm is disposed within the cavity of the base plate.

18. A method of removing excess material from an object using a press assembly having a die assembly and a cooperating punch assembly that is movable relative thereto, comprising:

placing the object on the die assembly;

removing the excess material from the object by moving the punch assembly downwardly relative to the die assembly such that the object is urged downwardly relative to the die assembly by the punch assembly until the excess material is removed from the object; and moving the punch assembly upwardly relative to the die assembly such that the object is moved upwardly relative to the die assembly by a portion of the punch assembly.

19. The method of claim 18, wherein the portion of the punch assembly that operatively engages the object is an ejector assembly that is mounted to the punch assembly.

20. The method of claim 18, wherein the step of removing the excess material from the object further comprises trimming excess material from a perimeter of the object.

* * * * *